US005558605A

United States Patent [19]

Gvoich

[11] Patent Number: 5,558,605

[45] Date of Patent: Sep. 24, 1996

[54] MOTOR-LESS TREADMILL WITH STEPPED-UP FLYWHEEL

[75] Inventor: Ned Gvoich, Beamsville, Canada

[73] Assignee: Kor-One, Ltd., Scottsdale, Ariz.

[21] Appl. No.: 452,103

[22] Filed: May 26, 1995

Related U.S. Application Data

[63] Continuation-in-part of Ser. No. 262,235, Jun. 20, 1994, Pat. No. 5,447,479.

[51] Int. Cl.[6] ..... A63B 22/02

[52] U.S. Cl. ..... 482/54; 482/119

[58] Field of Search ..... 482/54, 51, 114, 482/115, 119

[56] References Cited

U.S. PATENT DOCUMENTS

| | | | |
|---|---|---|---|
| 4,664,646 | 5/1987 | Rorabaugh | 482/54 |
| 4,792,134 | 12/1988 | Chen | 482/54 |
| 4,865,313 | 9/1989 | Kuo | 482/54 |
| 4,928,956 | 5/1990 | Chen | 422/54 |
| 5,431,612 | 7/1995 | Holden | 482/54 |

*Primary Examiner*—Lynne A. Reichard
*Attorney, Agent, or Firm*—O'Connor Cavanagh

[57] ABSTRACT

A treadmill having a frame with first and second rollers mounted at opposite ends of the frame and an endless tread belt placed about the rollers. The treadmill further including a flywheel attached to the frame and coupled to the first roller for rotatably driving the flywheel at a rate of rotation greater than the rate of rotation of the first roller. The coupling mechanism comprises a first drive wheel attached to the flywheel and a second drive wheel attached to the first roller with an endless drive belt placed around the drive wheels.

14 Claims, 2 Drawing Sheets

MOTOR-LESS TREADMILL WITH STEPPED-UP FLYWHEEL

CROSS-REFERENCE TO RELATED APPLICATION

This application is continuation-in-part of application Ser. No. 08/262,235, filed Jun. 20, 1994, now U.S. Pat. No. 5,447,479.

BACKGROUND OF THE INVENTION

This invention relates in general to exercise treadmills, and more particularly, to a motor-less exercise treadmill having a geared flywheel system to improve the momentary reaction of the tread-belt of the treadmill in response to a user increasing or decreasing his or her stride speed thereon.

For the fifth consecutive year, walking ranks No.1 in growth among 40 sports and fitness activities surveyed by the National Sporting Goods Association. In 1992 treadmills were rated the largest selling fitness product with 9.3 million users.

DESCRIPTION OF THE RELATED ART

In 1993, the motor-less treadmill was popularized by television infomercials by, among others, NORDIC TRACK of Minnesota and the La Fonda Group of California, who produced models such as "WALK FIT" and "WALK TO THE MUSIC" respectively.

These prior art devices are substantially similar in their design and their function. Generally, the prior art devices comprise a frame for mounting the components of the device which include; a front roller having one or more flywheels connected or integrally attached thereto; a back roller; a slider bed mounted on the frame intermediate to the forward and back rollers; and a endless tread-belt entraining the front roller, slider bed and back roller to provide a revolving tread-belt that is manipulated into motion by the user while walking or running thereon.

The objective of these prior art devices is to provide an affordable and aerobic exercise effective indoor walking or running treadmill device whereon a user may walk or run while maintaining his or her body geographically stationary.

The failure of the prior art to provide an effective aerobic exercise treadmill device, is best illustrated with a brief description of the normal walking biomechanics.

There are three phases to normal walking: "the heel strike phase", wherein the advancing foot strikes the exercise surface with the heel, which smoothly transitions to; the "foot flat phase", wherein the advancing foot moves backward in relation to the torso, and the leg is fully extended with the entire sole of the foot in contact with the exercise surface, which smoothly transitions to; the "push off phase", wherein the leg continues backward and the torso is propelled forward by the pushing off from the exercise surface with the big toe of the now trailing foot.

In order to generate a non-jarring, natural walking action, all three of the biomechanical phases of normal walking must occur in a coordinated transition, smoothly and without interruption, with the left and right legs reciprocating into and out of the three phases of walking.

The devices of the prior art do not provide the smooth transition of the three phases of normal walking due to their inefficient flywheel designs.

Walking on the tread-belt of the prior art devices demonstrates a sticking and binding of the tread-belt when the user's entire body weight is focused on the tread-belt during the "foot flat phase" of normal walking. The greater the user's weight the more demonstrable the sticking and binding of the tread-belt. The sticking and binding of the tread-belt relates to the inefficiency of the flywheel to deliver an effective inertia and momentum to the tread-belt. Sticking and binding of the tread-belt interrupts the smooth coordinated transition between the three phases of normal walking and thus predisposes the user's foot, knee, pelvis and lower spinal joints to injury. The risk of joint injury is substantially increased when the tread-belt sticks or stops abruptly, thereby subjecting the knee joint on the weight bearing side to hyperextension strain of the ligaments and hamstring muscles of the knee joint.

Furthermore, the flywheel design of the prior art fails to adequately control the tread-belt reaction in response to the user accelerating or decelerating his or her stride speed. This results in the tendency for the tread-belt to indiscriminately accelerate in response to the user pushing through the sticking point and during the push off phase of normal walking. The acceleration of the tread-belt, being out of synchrony with the user's stride speed, thus creates the potential for the user to fall forwardly.

Still a further drawback of the prior art devices relates to the inefficient tread-belt momentum supplied by the flywheel whereby the user is forced to stabilize his or her upper body by holding onto front stabilization rails, or in the case of the NORDIC TRACK design, by leaning into the a hip stabilizing pad, in order to manipulate the tread-belt into a smooth steady motion.

In order to overcome the inefficiencies of the flywheel design of the prior art a substantially larger and heavier flywheel would be required. A larger and heavier flywheel would generate a greater centrifugal force and thereby provide a greater inertia and momentum to the tread-belt. However, including a larger and heavier flywheel is prohibited by both the cost and the design parameters of the prior art devices.

OBJECTS OF THE INVENTION

The motor-less treadmill of the present invention solves all of the problems inherent to the motor-less treadmills of the prior art. The invention includes a simple cost effective and design compatible modification to the flywheel systems of the prior art. This modification improves the efficacy of the prior art flywheel providing a control to the tread-belt of the device which vastly improves the momentary reaction of the tread-belt in response to the user changing his or her stride speed. The invention prevents sticking of the tread-belt in the foot flat phase of normal walking, substantially reduces the need for the user to brace his or her upper body against a supporting rail in order to manipulate the tread-belt into a smooth and steady motion and prevents the indiscriminate acceleration of the tread-belt out from under the user while still achieving the objectives of the prior art devices which, simply stated, is to provide an affordable and exercise effective motor-less treadmill device.

Objectives of the invention include providing affordable, comfortable and effective indoor aerobic walking or running exercise treadmill.

A still further objective of the invention is to provide a motor-less treadmill that is economical to manufacture, easy to use, rugged, of simple construction and which has a long service life.

A further objective of the invention is to provide a motor-less treadmill having a tread-belt that is acutely responsive to the acceleration or the deceleration of the user's stride speed.

Yet a further objective of the invention is to provide a motor-less treadmill which may be elevated at it's forward end to thereby provide for an increase in the intensity of the exercise.

Another objective of the invention is to provide a motor-less treadmill that can provide a smooth coordinated operation, regardless of a users weight, thus providing an increased margin of safety to the user.

SUMMARY OF THE INVENTION

The objectives identified above, as well as other advantages and features of the invention are provided in a motor-less exercise treadmill which includes a structural main frame comprised of a pair of side-rail members, a front mounting bracket and a platform support frame mounted between the side-rail members. A slider bed is mounted on the platform support frame between the side-rail members and between a front and a rear roller, each roller being journaled transversely at the front and rear ends of the main frame. A flexible tread-belt is entrained about the rollers and over the slider bed.

In a preferred embodiment a first flywheel and first pulley are connected to one of the rollers. A second flywheel is driven by the first flywheel or roller via gears, frictional engagement, chain drive or, preferably, an elastomeric endless drive belt about the first pulley and a second, smaller pulley fixed to or integral with the second flywheel.

A grasp-rail is attached to the main frame which the user may grasp, at will, for stability. The grasp-rail may also serve for the attachment of various accessories, such as electronic diagnostic equipment and/or a audio tape player. Left and right arms of the grasp rail are mounted on the front bracket of the main frame and terminate in left and right tubular ends into which are inserted a pair of tubular front legs having a adjustability means for varying the height of the front end of the main frame. A pair of back legs suspend the rear of the main frame from the floor surface.

With a user walking or running on the tread-belt of the present invention, the drive roller, which may be the rear, but is preferably the front roller, rotates at substantially the speed of the tread belt. A drive means, which may be a system of chains and sprockets, gears, frictional engagement or, preferably, pulleys and an elastomeric belt, drives a flywheel at a rotational speed greater than that of the roller. The faster rotating flywheel generates a rotating inertia in that is transmitted back to the rollers to impart an effective influence to the inertia and momentum of the tread-belt of the treadmill device and thereby improve the momentary reaction response of the tread-belt in relation to a user increasing or decreasing his or her stride speed thereon. The user may vary the intensity of the exercise by either raising or lowering the front end of the main frame by adjusting the height of the front legs.

The modified flywheel arrangement of the embodiment may be retro-fitted to the motor-less treadmills of the prior art by the mounting of the modified first flywheel and first pulley arrangement on the front roller and mounting the second flywheel and second pulley arrangement forward or rearward of the front roller, as the design of the prior art device permits.

Preferred embodiments of the invention, illustrative of the best modes in which applicants have contemplated applying the principles, are set forth in the following description and are shown in the drawings and are particularly and distinctly pointed out and set forth in the appended claims.

BRIEF DESCRIPTION OF THE DRAWINGS

Similar numerals refer to similar parts throughout the drawings.

DESCRIPTION OF THE PREFERRED EMBODIMENTS

Figure 1:
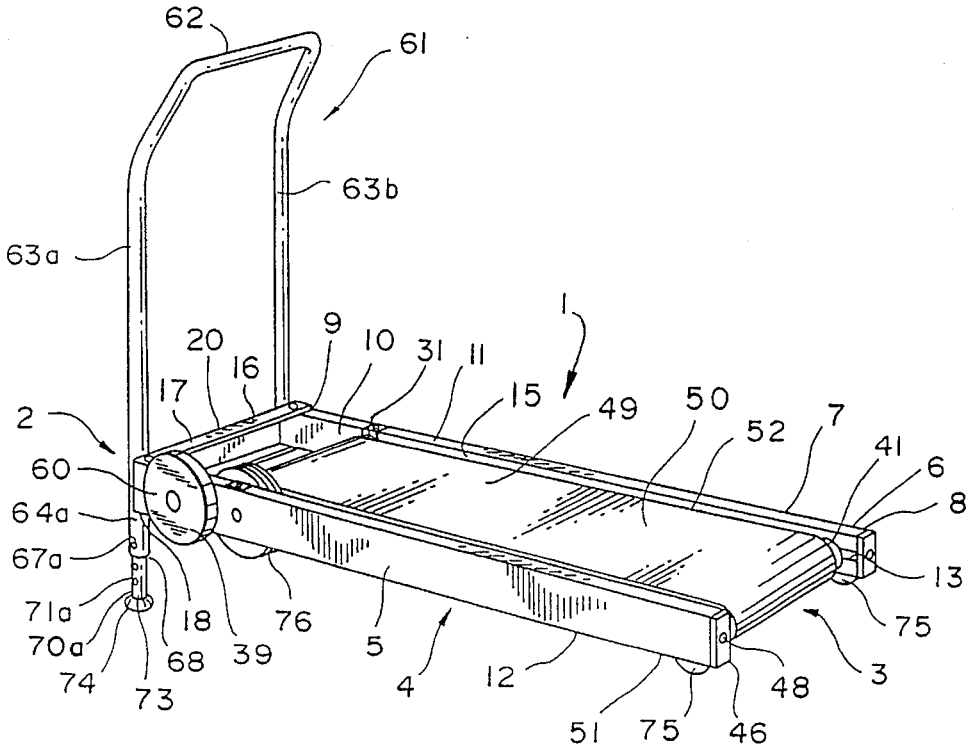
FIG. 1 is a left side perspective view of an embodiment of the exercise treadmill of the present invention.
Figure 2:
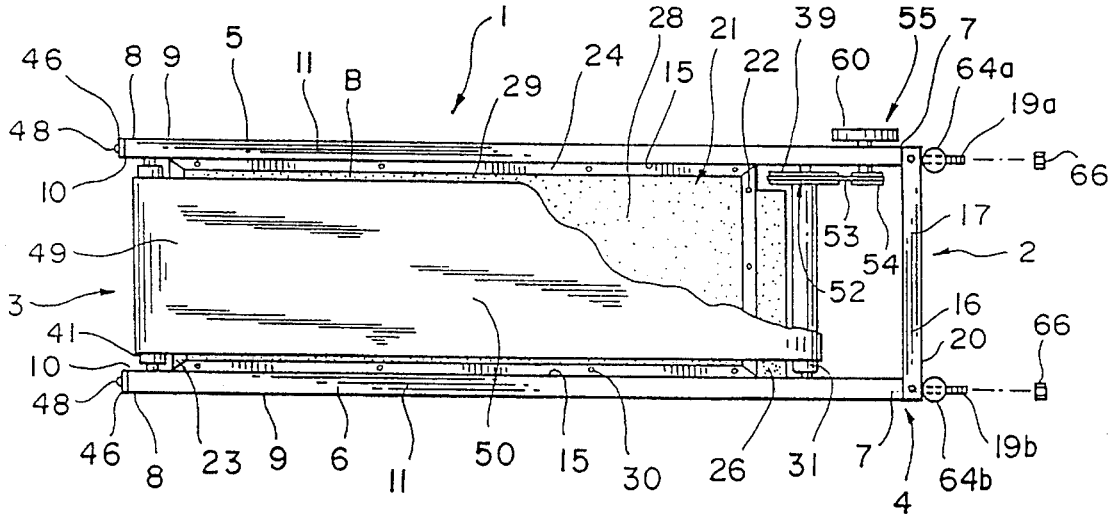
FIG. 2 is a top plan view of FIG. 1 illustrating the upper reach of the tread-belt cut away to further illustrate a slider bed and a platform support frame.

The treadmill assembly of the present invention is shown in FIG. 1 indicated generally at 1. Treadmill 1 is shown in greater detail in FIGS. 2–4. Referring first to FIGS. 1 and 2 it may be seen that treadmill assembly 1 has a front end 2 and a rear end 3 and generally includes as its main components; a substantially planar trihedral main frame indicated generally at 4 which comprises a left and a right side-rail 5 and 6, a front transverse mounting bracket 16 and a platform support frame 21 affixed transversely to the side-rails 5 and 6; a slider bed 26; a front roller 31; a rear roller 41; an endless tread-belt 49; a first flywheel and first pulley arrangement indicated generally at 52; a second flywheel and second pulley arrangement indicated generally at 55; a flexible endless drive belt 53; a one-piece U-shaped tubular rail indicated generally at 61 including a grasp-rail 62, a left and right tubular arm **63*a* and 63*b* respectively and left and right tubular ends 64*a* and 64*b* respectively; a pair of adjustable tubular front legs 70*a* and 70*b* and a pair of back legs 75**.

Figure 3:
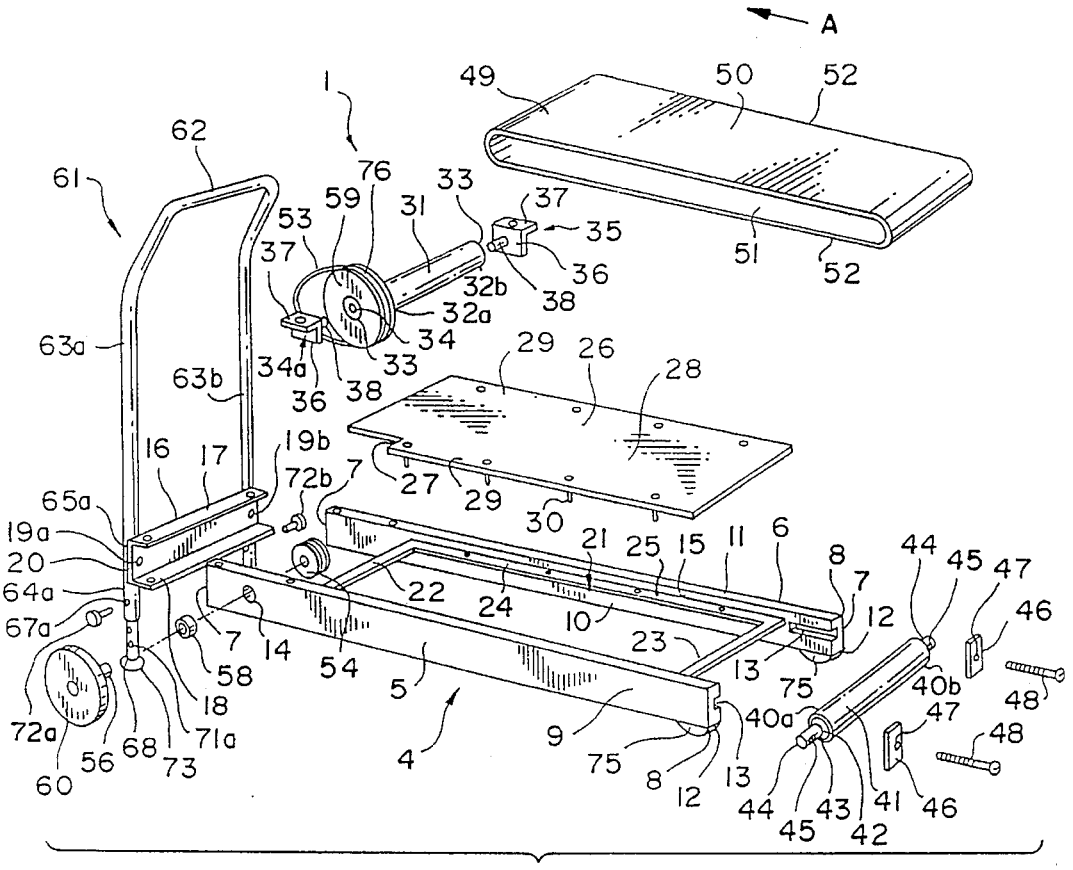
FIG. 3 is a left side perspective assembly view of the exercise treadmill of FIG. 1 with parts broken away for clarity, illustrating the components of the present invention.
Figure 4:
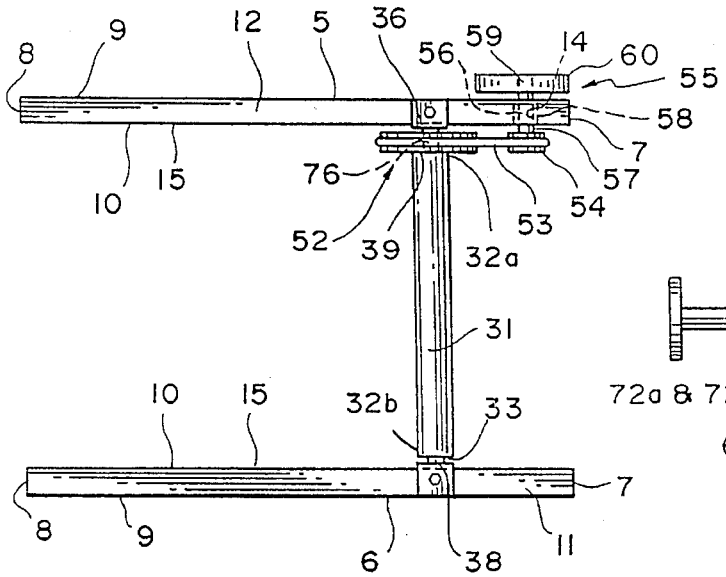
FIG. 4 is a top plan partial view of the forward main frame of the exercise treadmill of FIG. 1 illustrating the first flywheel and first pulley arrangement and the second flywheel and second pulley arrangement and including an exploded perspective view of the front leg assembly.

Referring now more particularly to FIGS. 2–4, it may be seen that the main frame 4 of treadmill 1 comprises a left and a right spaced side-rail 5 and 6 respectively, extending generally lengthwise of the treadmill 1. The side-rails 5 and 6 of the main-frame 4 are formed as a hollow rectangular shaped channel member, preferably made of a suitable metal or plastic material extruded or stamped however, other suitable materials such as wood may be used. More specifically, the side-rails 5 and 6 include a front end 7, a rear end 8, a vertical lateral wall 9, a vertical medial wall 10, a top wall 11, and a lower wall 12. The medial walls 10 of the side-rails 5 and 6 include a central slot 13 which extends approximately six inches from the rear end 8 toward the front end 7 of the left and right side-rails 5 and 6. A bore 14 is provided through the lateral wall 9 and the medial wall 10 spaced approximately six inches from the front end 7 of the left side-rail 5. Side-rails 5 and 6 are retained in a spaced apart relation at their front ends by the mounting bracket 16 having a top flange 17 and a bottom flange 18 which are screwed, bolted or otherwise rigidly connected transversely to the top walls 11 at the front end 7 of the side-rails 5 and 6. Side-rails 5 and 6 are further retained in a spaced apart relation, along their length, by the platform support frame 21 which includes a front end 22, a back end 23 and a left and right side 24. Sides 24 are bolted, welded or otherwise rigidly affixed along the length of the medial walls 10 of rails 5 and 6. Side-rails 5 and 6, bracket 16 and platform support frame 21 provide the main frame 4 with the platform support frame 21 positionally supporting and retaining the slider bed 26 in relation to the main frame 4.

Mounting bracket 16 is preferably formed from metal or plastic and includes a left and right spaced threaded boss 19*a* and 19*b* respectively, which are bolted or welded to, or integrally formed in, a front wall 20 of the bracket 16 to generally mount, in a spaced apart relation, the left and right arms 63*a* and 63*b* respectively, of the U-shaped tubular rail 61 to the main frame 4.

The slider bed 26 substantially supports a upper reach 50 of the endless tread-belt 49 and is preferably formed of a stationary metal, wood or plastic plank having a length extending substantially between the front roller 31 and the rear roller 41. Slider bed 26 is preferably of a width somewhat greater than the width of the tread-belt 49 and extends out beyond a left and a right outer edge 52 of the tread-belt 49 with the outer edges 52 terminating short of a left and a right side edges 29 of the slider bed 26. A gap B is provided by the slider bed 26 between the outer edges 52 of the tread-belt 49 and a inner left and right edges 15 of the left and right side-rails 5 and 6 to thereby prevent a binding or rubbing of the edges 52 of the tread-belt 49 with the edges 15 of the side-rails 5 and 6. Slider bed 26 is secured by screws 30 to a top surface 25 of the side members 24 of the platform support frame 21. The slider bed 26 is maintained in close proximity to the upper reach 50 of the tread-belt 49 to thereby prevent sagging or yielding of the tread-belt 49 in response to the user walking or running thereon. Alternatively, the slider bed 26, the platform support frame 21, side-rails 5 and 6, and the bracket 16, or any combinations thereof, may be integrally formed as a unitary plastic injected member.

The front and rear rollers 31 and 41 respectively, are preferably formed of a plastic or metal hollow cylindrical tube. The front roller 31 includes a left and a right fitted end cap 33 having a conventional roller-bearing 34 integrally formed, or rigidly affixed, at their centers. The end caps 33, including the roller-bearings 34, are press fit, glued, riveted or otherwise rigidly secured in a respective left and right end 32*a* and 32*b* respectively, of the front roller 31. A left and a right front roller mounting angle bracket 34*a* and 35 respectively, include short shafts 38 which project substantially horizontally and medially from the center of the lower leaf 36 of the brackets 34*a* and 35. The shafts 38 are journaled in the roller-bearings 34 mounted in the end caps 33 of the front roller 31 so that the front roller 31 is free wheeling. A upper leaf 37 of the roller mounting angle brackets 34*a* and 35 is adapted to be bolted, welded or otherwise rigidly affixed forwardly on the top wall 11 of the left and right side-rail members 5 and 6 respectively, to thereby mount the front roller 31 near the front end 7 of the main frame 4 of the treadmill 1. The front roller 31 is adapted to include a first flywheel 39 integrally formed, or otherwise rigidly connected, to the left end 32 of the roller 31. The rear roller 41 includes a left and a right fitted end cap 42 having a conventional roller-bearing 43 integrally formed in, or otherwise rigidly affixed, at their centers. The end caps 42, including the roller-bearings 43, are press fit, glued, riveted, or otherwise rigidly secured, to a left and a right end 40*a* and 40*b* of the rear roller 41. The rear roller 41 includes a axle 44 projecting substantially horizontally through the length of the rear roller 41 and extending approximately one inch lateral to the left and right roller end caps 42 to form a left and a right mounting shaft 44, so that the rear roller 41 is free wheeling. A threaded bore 45 is provided in the left and right mounting shafts 44, and the shafts 44, are journaled within the slots 13 provided at the rear end 8 of the left and right side-rail members 5 and 6. A flat roller mounting plate 46 is sized and shaped to fit snugly against the left and right ends 8 of the left and right side-rail members 5 and 6. The mounting plate 46 includes a threaded bore 47 which engages an adjustment bolt 48. The adjustment bolt 48 threads through the bore 47 of the mounting plate 46 to engage with the threaded bore 45 of the left and right mounting shafts 44, of the rear roller 41. The rear roller 41 may be positionally adjusted to thereby loosen or tighten the tread-belt around the rollers of the treadmill by the simultaneous screwing or unscrewing of the adjustment bolt 48 in a clockwise or in a counter-clockwise direction, respectively.

The endless tread-belt 49 is preferably formed of a rubber, vinyl or other suitable flexible material and is entrained around the front and rear rollers 31 and 41 and includes an upper reach 50 and a lower reach 51. The upper reach 50 moves from front to rear so that a user standing on the upper operative surface of the upper reach 50 of the tread-belt 49 may walk or run in a forward direction, as indicated by arrow A of FIG. 3, and remain stationary relative to the main frame 4 of the treadmill 1.

Referring now more specifically to FIG. 4 it may be seen that the first flywheel and first pulley arrangement generally indicated at 52 includes a first flywheel 39 which is integrally formed, but may be otherwise rigidly connected to, the left end 32*a* of the front roller 31. The first flywheel 39 is preferably formed from a machined, cast or molded steel plate but may alternatively be formed of a sand filled vinyl casting or of any other suitable material having a weight substantially sufficient to function for the intended purpose of the flywheel. The first flywheel 39 includes a groove 76 about its perimeter so as to function as a flywheel and pulley in combination forming the first flywheel and first pulley arrangement indicated generally at 52. The flexible endless drive belt 53 is preferably formed from a flexible elastomer or rubber material and is entrained about the first flywheel and first pulley arrangement 52 and about a second pulley 54 of the second flywheel and second pulley arrangement 55. The second pulley 54 is formed preferably of metal or plastic materials and has a diameter four to five times smaller than the first flywheel and first pulley arrangement 52. Pulley 54 is rigidly connected to an inside projection 57 of the axle 56 and is positionally aligned with the first flywheel and first pulley arrangement 52 to thereby prevent excessive wear of the drive belt 53, or slippage of the drive belt 53 out from the first flywheel and first pulley arrangement 52 and/or out from the second pulley 54 during use of the device. The axle 56 is preferably formed of a metal or plastic material and is retained in a bushing 58 which is press fit or otherwise rigidly affixed in the bore 14 provided through the lateral and medial walls 9 and 10 respectively, near the front end 7, forward of the first flywheel and first pulley arrangement 52, of the left side rail 5 of the main frame 4. The axle 56 passes through the bushing 58 to form an outside projection 59 of the axle 56 having the second flywheel 60 rigidly connected thereto. The second flywheel 60 is of a similar construction to flywheel 39.

The U-shaped tubular rail 61 is formed from a one-piece bent metal or molded plastic tube and includes; a substantially horizontal upper U-shaped portion which forms the grasp-rail 62 centrally and extending peripherally to form the left and right arms 63*a* and 63*b* respectively which terminate in the left and right tubular ends 64*a* and 64*b* respectively. The left and a right tubular arms 63*a* and 63*b* include a bore 65*a* and 65*b* respectively, through their respective sidewalls. Bores 65*a* and 65*b* are spaced approximately ten inches proximal to the free ends of the left and right tubular ends 64*a* and 64*b* of rail 61. Bores 65*a* and 65*b* align and engage with the respective bosses 19*a* and 19*b* provided on the front wall 20 of bracket 16 to generally mount the left and right arms 63*a* and 63*b* of U-shaped rail 61, in a spaced apart relation, to the bracket 16 at the front end 2 of the treadmill 1. Nuts 66 are threaded on bosses 19*a* and 19*b* and tightened against the arms 63*a* and 63*b* to positionally retain U-shaped rail 61 on bracket 16 at the front end 2 of the main frame 4 of the treadmill 1. U-shaped rail 61 extends approximately thirty-six inches upwardly from the upper edge of bracket 16 at the front end 4 of the treadmill 1 providing the user with the grasprail 62 for stability. Bores 67*a* and 67*b* are provided in the respective sidewalls of the tubular ends 64*a* and 64*b* spaced approximately five inches proximal to the free ends of the tubular ends 64*a* and 64*b* of rail 61. With rail 61 mounted on bracket 16 the tubular ends 64*a* and 64*b* project approximately four inches below the lower edge of the bracket 16 of the main frame 4 and bores 67*a* and 67*b* project approximately one inch below the lower edge of the bracket 16 of the main frame 4. A bottom end 68 of the tubular ends 64*a* and 64*b* slidingly receives a top end 69 of the tubular front legs 70*a* and 70*b* respectively. The tubular front legs 70*a* and 70*b* having a overall length of approximately ten inches and formed of a plastic or metal tube of a smaller diameter than the diameter of the tubular ends 64*a* and 64*b* of the rail 61.

Tubular front legs 70*a* and 70*b* include a plurality of spaced bores 71*a* and 71*b* through their respective sidewalls, along their respective length. The tubular front legs 70*a* and 70*b* and tubular ends 64*a* and 64*b* are uniformly secured and retained, with respect to each other respectively, by the alignment of the bore 67*a* of the left tubular end 64*a* with one of the bores 71*a* of left tubular leg 70*a* and by aligning bore 67*b* of the right tubular end 64*b* with the matching bore 71*b* of right tubular leg 70*b* having a detachable pin 72*a* and 72*b* disposed respectively, therethrough. Legs 70*a* and 70*b* are uniformly raised or lowered by selecting a particular matching bore 71*a* and 71*b* provided in each of the front legs 70*a* and 70*b* and aligning the selected bores 71*a* and 71*b* with the bores 67*a* and 67*b* and securing their alignment with the pins 72*a* and 72*b* to thereby selectively raise or lower the front end 4 of treadmill 1 to increase or decrease the intensity of the exercise as desired.

Figure 5:
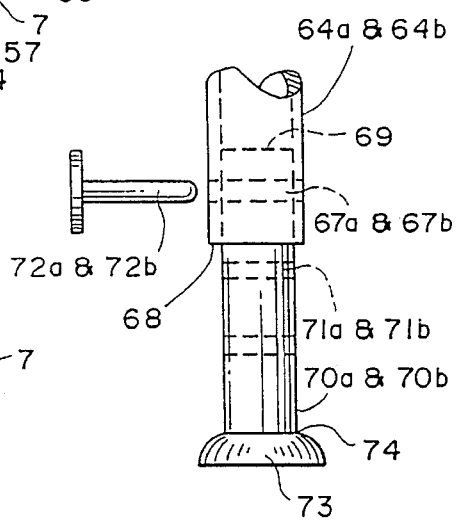
FIG. 5 is a side plan partial view of the front support legs of the exercise treadmill of FIG. 1, illustrating the height adjustment mechanism.

As shown in FIG. 5, a plastic or rubber foot 73 is press-fit or otherwise attached to a bottom end 74 of legs 70*a* and 70*b* to protect the floor surface. A pair of static back legs 75, formed of plastic, rubber or other suitable material, are screwed, bolted, glued or otherwise rigidly connected to the lower wall 12 of the left and right side-rails 5 and 6 at the rear end 8 of the side-rails 5 and 6 of the treadmill 1. Back legs 75 and are of a sufficient height so as to ensure that the main frame 4 is substantially horizontally supported above the floor when the front legs 70*a* and 70*b* are maximally disposed within the tubular ends 64*a* and 64*b* and the front end 4 of the treadmill 1 so that the frame 4 is supported at its lowest height, as best illustrated in FIG. 1.

During operation of the treadmill 1 the user manipulates the tread-belt 49 into a front to back motion by walking or running on the upper reach 50 of the tread-belt 49. The front to back movement of the tread-belt 49 causes the front roller 31 and the first flywheel and first pulley arrangement 52 to rotate in a clockwise direction. The second pulley 54, having a diameter smaller than the first flywheel and first pulley arrangement 52, connected thereto by the drive belt 53, and further connected by the axle 56 to the second flywheel 60 causes the second flywheel 60 to rotate at a faster speed than the first flywheel and first pulley arrangement 52 rotates. The faster rotating second flywheel 60 generates a centrifugal force which is transmitted back through the first flywheel and first pulley arrangement 52 to impart a controlled inertia and momentum to the tread-belt 49, thereby improving the momentary reaction of the tread-belt 49 in response to a user increasing or decreasing his or her stride speed thereon.

By using an endless belt drive by way of example it is not intended to limit the present invention to driving the second flywheel by way of an endless belt, any conventional means for stepping-up the rotational speed at a driving flywheel is considered to be within the slope of the present invention. For example, use of chains and sprockets are considered to be equivalent means. Similarly, use of directly engaging gears or friction drives such as rubber wheels, in which case the second flywheel would counter-rotate with respect to the first flywheel, are considered to be equivalent means.

In the foregoing description, certain terms have been used for brevity, clearness and understanding; but no unnecessary limitations are to be implied therefrom beyond the requirement of the prior art, because such terms are used for descriptive purposes and are intended to be broadly construed. Moreover, the description and illustration of the invention is by way of example, and the scope of the invention is not limited to the exact details shown or described. Having now described the features, discoveries and principles of the invention, the manner in which the improved treadmill assembly is constructed and used, the characteristics of the construction, and the advantageous, new and useful results obtained; the new and useful structures, devices, elements, arrangements, parts and combinations, are set forth in the appended claims.

What is claimed is:

1. An exercise treadmill, comprising:

a main frame;

a handrail attached to said main frame;

a first roller rotatably mounted on said main frame;

a second roller rotatably mounted on said main frame;

an endless tread belt placed about said first roller and said second roller;

a first flywheel rotatably attached to said main frame; and, a coupling means between said first flywheel and said first roller for rotatably driving said first flywheel at a rate of rotation greater than the rate of rotation of said first roller, wherein said coupling means comprises a first drive wheel attached to said first flywheel; a second drive wheel attached to said first roller; and, an endless drive belt placed around said first drive wheel and said second drive wheel.

2. An exercise treadmill, comprising:

a main frame;

a handrail attached to said main frame;

a first roller rotatably mounted on said main frame;

a second roller rotatably mounted on said main frame;

an endless tread belt placed about said first roller and said second roller;

a first flywheel rotatably attached to said main frame; and a coupling means between said first flywheel and said first roller for rotatably driving said first flywheel at a rate of rotation greater than the rate of rotation of said first roller, wherein said coupling means comprises a first sprocket attached to said first roller; a second sprocket attached to said first flywheel, wherein the diameter of said second sprocket is less than the diameter of said first sprocket; and, an endless chain placed around said first gear and said second gear.

3. An exercise treadmill, comprising:

a main frame;

a handrail attached to said main frame;

a first roller rotatably mounted on said main frame;

a second roller rotatably mounted on said main frame;

an endless tread belt placed about said first roller and said second roller;

a first flywheel rotatably attached to said main frame; and, a coupling means between said first flywheel and said first roller for rotatably driving said first flywheel at a rate of rotation greater than the rate of rotation of said first roller, wherein said coupling means comprises a first gear attached to said first roller; and, a second gear attached to said first flywheel, wherein the diameter of said second gear is less than the diameter of said first gear, wherein said first gear engages said second gear.

4. An exercise treadmill, comprising:

a main frame;

a handrail attached to said main frame;

a first roller rotatably mounted on said main frame;

a second roller rotatably mounted on said main frame;

an endless tread belt placed about said first roller and said second roller;

a first flywheel rotatably attached to said main frame; and, a coupling means between said first flywheel and said first roller for rotatably driving said first flywheel at a rate of rotation greater than the rate of rotation of said first roller, wherein said coupling means comprises a first drive wheel attached to said first roller; and, a second drive wheel attached to said first flywheel, wherein the diameter of said second drive wheel is smaller than the diameter of said first drive wheel, wherein said first drive wheel frictionally engages said second drive wheel.

5. An exercise treadmill, comprising:

a main frame;

a handrail attached to said main frame;

a first roller rotatably mounted on said main frame;

a second roller rotatably mounted on said main frame;

an endless tread belt placed about said first roller and said second roller;

a first flywheel rotatably attached to said main frame;

a second flywheel attached to said first roller, and, a coupling means between said first flywheel and said first roller for rotatably driving said first flywheel at a rate of rotation greater than the rate of rotation of said first roller.

6. The apparatus of claim 5 wherein said coupling means comprises:

a first drive wheel attached to said first flywheel;

a second drive wheel attached to said first roller; and, an endless drive belt placed around said first drive wheel and said second drive wheel.

7. The apparatus of claim 6 wherein said coupling means comprises:

a first sprocket attached to said first roller;

a second sprocket attached to said first flywheel, wherein the diameter of said second sprocket is less than the diameter of said first sprocket; and, an endless chain placed around said first gear and said second gear.

8. The apparatus of claim 6 wherein said coupling means comprises:

a first gear attached to said first roller; and, a second gear attached to said first flywheel, wherein the diameter of said second gear is less than the diameter of said first gear, wherein said first gear engages said second gear.

9. The apparatus of claim 6 wherein said coupling means comprises:

a first drive wheel attached to said first roller; and, a second drive wheel attached to said first flywheel, wherein the diameter of said second drive wheel is smaller than the diameter of said first drive wheel, wherein said first drive wheel frictionally engages said second drive wheel.

10. An exercise treadmill, comprising:

a main frame;

a handrail attached to said main frame;

a first roller rotatably mounted on said main frame;

a second roller rotatably mounted on said main frame;

an endless belt placed about said first roller and said second roller;

a first flywheel attached to said main frame;

a coupling means between said first flywheel and said first roller for rotatably driving said first flywheel at a rate of rotation greater than the rate of rotation of said first roller; further comprising a second flywheel attached to said first roller; and, wherein said coupling means provides a gear ratio between 4 to 1 and 5 to 1.

11. The apparatus of claim 10 wherein said coupling means comprises:

a first drive wheel attached to said first flywheel;

a second drive wheel attached to said first roller; and, an endless drive belt placed around said first drive wheel and said second drive wheel.

12. The apparatus of claim 10 wherein said coupling means comprises:

a first sprocket attached to said first roller;

a second sprocket attached to said first flywheel, wherein the diameter of said second sprocket is less than the diameter of said first sprocket; and, an endless chain placed around said first gear and said second gear.

13. The apparatus of claim 10 wherein said coupling means comprises:

a first gear attached to said first roller; and, a second gear attached to said first flywheel, wherein the diameter of said second gear is less than the diameter of said first gear, wherein said first gear engages said second gear.

14. The apparatus of claim 10, wherein said coupling means comprises:

a first drive wheel attached to said first roller; and, a second drive wheel attached to said first flywheel, wherein the diameter of said second drive wheel is smaller than the diameter of said first drive wheel, wherein said first drive wheel frictionally engages said second drive wheel.

* * * * *